US005484508A

United States Patent [19]

Urwin et al.

[11] Patent Number: 5,484,508

[45] Date of Patent: Jan. 16, 1996

[54] METHOD OF MAKING A LIQUID FEEDSTOCK FROM A PLURALITY OF PULP SHEET STOCK ROLLS

[75] Inventors: Philip J. Urwin, Coventry; Iain R. Jack, Nuneaton, both of United Kingdom

[73] Assignee: Courtaulds Fibres (Holdings) Ltd., London, England

[21] Appl. No.: 67,432

[22] Filed: May 24, 1993

[51] Int. Cl.[6] ..... D21B 1/04

[52] U.S. Cl. ..... 162/28; 162/259; 241/27; 241/220

[58] Field of Search ..... 162/4, 28, 265, 162/259, 261; 241/73, 227, 186.4, 189.1, 226; 156/62.4; 264/116

[56] References Cited

U.S. PATENT DOCUMENTS

| | | | |
|---|---|---|---|
| 3,350,262 | 10/1967 | Cummins | 162/255 |
| 3,591,450 | 7/1971 | Murphy et al. | 162/28 |
| 4,241,881 | 12/1980 | Laumer | 241/73 |
| 4,421,800 | 12/1983 | Schoenberg | 118/677 |
| 5,223,329 | 7/1993 | Amann | 428/198 |
| 5,316,601 | 5/1994 | Hebbard et al. | 156/62.4 |

FOREIGN PATENT DOCUMENTS

| | | |
|---|---|---|
| 1483748 | 8/1977 | United Kingdom . |

*Primary Examiner*—W. Gary Jones
*Assistant Examiner*—Dean T. Nguyen
*Attorney, Agent, or Firm*—Davis Hoxie Faithfull & Hapgood

[57] ABSTRACT

A method of making feedstock from material supplied in rolls of flexible sheet material which comprises the steps of creating a pluri-layer web of "n" different layers of sheet material, each layer being selected with regard to some known parameter property of the sheet material whereby the pluri-layer web has an aggregate value of the selected parameter which lies within a chosen range of values of said parameter property. Conveniently the feedstock is created by disintegrating the pluri-layer web to create a mass of comminuted pieces of sheet material.

12 Claims, 2 Drawing Sheets

METHOD OF MAKING A LIQUID FEEDSTOCK FROM A PLURALITY OF PULP SHEET STOCK ROLLS

BACKGROUND OF THE INVENTION

FIELD OF THE INVENTION

This invention relates to a the creation of feedstock for a processing operation which feedstock is supplied in rolls of flexible sheet material subsequently comminuted to produce a mass of small pieces broken from the flexible sheet material. The invention also extends to a feedstock created from a plurality of rolls of sheet material and to feedstock-creating apparatus which utilises a plurality of rolls of sheet material.

The invention has particular, but not exclusive, application to cellulosic-based feedstock materials which may be used, inter alia, in the production of cellulosic fibres.

As primarily described herein, the process relates to the creation of batches of feedstock material but it is not ruled out that the invention can be used for a continuously operating plant.

Long lengths of sheet material are commonly supplied to end users in roll form, each roll being categorised with reference to at least one critical property of the sheet material, the end user selecting which rolls to use for the creation of a feedstock on the basis of an assessment of the values of the particular property assigned to the rolls that will be used for that feedstock. The invention has particular, but not exclusive, application to the situation where the eventual feedstock required for subsequent processing is created by mixing together small pieces removed from the sheet material drawn from a number of different rolls.

SUMMARY OF THE INVENTION

According to one aspect of this invention a method of making feedstock from material supplied in rolls of flexible sheet material comprises the steps of creating a pluri-layer web of "n" different layers of sheet material, each layer being selected with regard to some known parameter property of the sheet material whereby the pluri-layer web has an aggregate value of the selected parameter which lies within a chosen range of values of said parameter property. Conveniently the feedstock is created by disintegrating the pluri-layer web to create a mass of comminuted pieces of sheet material.

According to a further aspect of the present invention a feedstock material for subsequent processing comprises a pluri-layer web of "n" layers of sheet material laid one on the other.

According to a still further aspect of the present invention apparatus for producing a feedstock from stock rolls of sheet material comprises a roll stand for supporting a plurality of different stock rolls in side-by-side relationship, means for drawing sheet material from each of said stock rolls to form a pluri-layer web with "n" layers of sheet material disposed one on another, and means defining an output of the apparatus through which said pluri-layer web can be forwarded for subsequent processing.

Typically "n" is between 4 and 12.

In the production of cellulosic fibres it is known to use as raw material wood pulp wound in stock rolls of sheet material, to break up the sheet material in a mechanical pulp mill and to convey the broken pieces of sheet material from the mill to a subsequent processing station. The subsequent processing can be critically dependent on the aggregate properties of the mass of broken pieces. This invention, in its different aspects, relates to a novel way of feeding individual layers of sheet material as a pluri-layer web of raw material capable, on comminution in the mill, of producing a mass of broken pieces of the required aggregate properties.

In the case of stock rolls of sheet-formed wood pulp, suppliers grade the sheet-formed material on a roll, inter alia, on the basis of the viscosity of a liquid product produced in a pre-determined manner from the wood pulp and supply the roll to the end user with a viscosity rating. The end user can then select from the range of stock rolls available those having viscosity ratings which he wishes to use for a particular feedstock material.

In accordance with this invention, prior to creating the feedstock material from a plurality of different stock rolls of selected viscosity rating, the sheet materials from a number of stock rolls are drawn together to create a pluri-layer web which is fed as such to a pulp mill for comminution to create the required feedstock material.

By the simple expedient of creating a pluri-layer web we have found it possible to simplify the manufacture of feedstock, to improve the storage and processing of stock rolls and to exercise greater control over the production of the required feedstock material.

In a preferred arrangement, two or more separate pluri-layer webs are created utilising a separate roll stand for each web, the feedstock material being created from a preselected ratio of the amount of web material taken from the different stands.

Conveniently a first roll stand carries only stock rolls having a viscosity rating in a lower value (hereafter referred to as "LV") band and a second roll stand contains only stock rolls having viscosities in a higher value (hereafter referred to as "HV") band, the feedstock material being created from pluri-layer webs taken from both roll stands.

In the creation of cellulosic fibres we have found it to be important to control not only the aggregate value of the viscosity ratings of the layers making up the LV web and the aggregate value of the viscosity ratings of the layers making up the HV web but also to control the proportion of the LV to HV webs used in the final feedstock.

Where just two roll stands are used it has been found desirable to have different numbers of stock rolls in each stand. One convenient arrangement is for there to be $^{2p}/3$ layers of sheet material in the web leaving the LV apparatus and $^{p}/3$ layers of sheet material in the web leaving the HV apparatus, p being an integer number which is a multiple of 3 and which is not less than 6. p equal to 12 has been found to be a particularly convenient arrangement.

Preferably in the or each roll stand, the sheet material from each stock roll is fed into an unwinding station comprising a pair of rollers each contacted only over part of its circumference by the unwinding sheet material, the downstream roller of each pair defining an advance path for the composite web created in that roll stand. One of the rollers in each pair can be linked to a motion sensing means to detect when the sheet material in that unwinding station is no longer advancing e.g. due to breakage of the sheet material or expiry of the material on that stock roll.

Conveniently the advance path of the pluri-layer web created in the or each stand is disposed below all the stock rolls in that stand. The outlet of the or each roll stand can be provided by a pair of rollers defining a nip, one or both of said nip-defining rollers being driven to advance the web and thereby to draw sheet material off each of the stock rolls providing input for the web. The or each roll stand can be adjacent to a stock-holding area which can comprise an input end where stock rolls are first stored on receipt from a supplier and an output end having separate LV and HV storage areas where selected stock rolls for subsequent early use in the appropriate stand can be located. The rolls are selected to ensure adequate stocks of each type, stock rotation and a good mix of rolls made available for use.

To facilitate optimum selection of stock rolls from the storage area, each stock roll is assigned an identity which is applied to the stock roll in machine-readable form. The roll identity allows the property of each roll to be recovered from a database, and computing means are employed to determine, on the expiry of any stock roll in the roll stand, which is the best stock roll to take as replacement to maintain the correct aggregate value for the newly constituted web to be created from that stand.

BRIEF DESCRIPTION OF THE DRAWINGS

One embodiment of apparatus in accordance with this invention will now be described, by way of example, with reference to the accompanying drawings, in which.

DESCRIPTION OF THE PREFERRED EMBODIMENT

Figure 1:
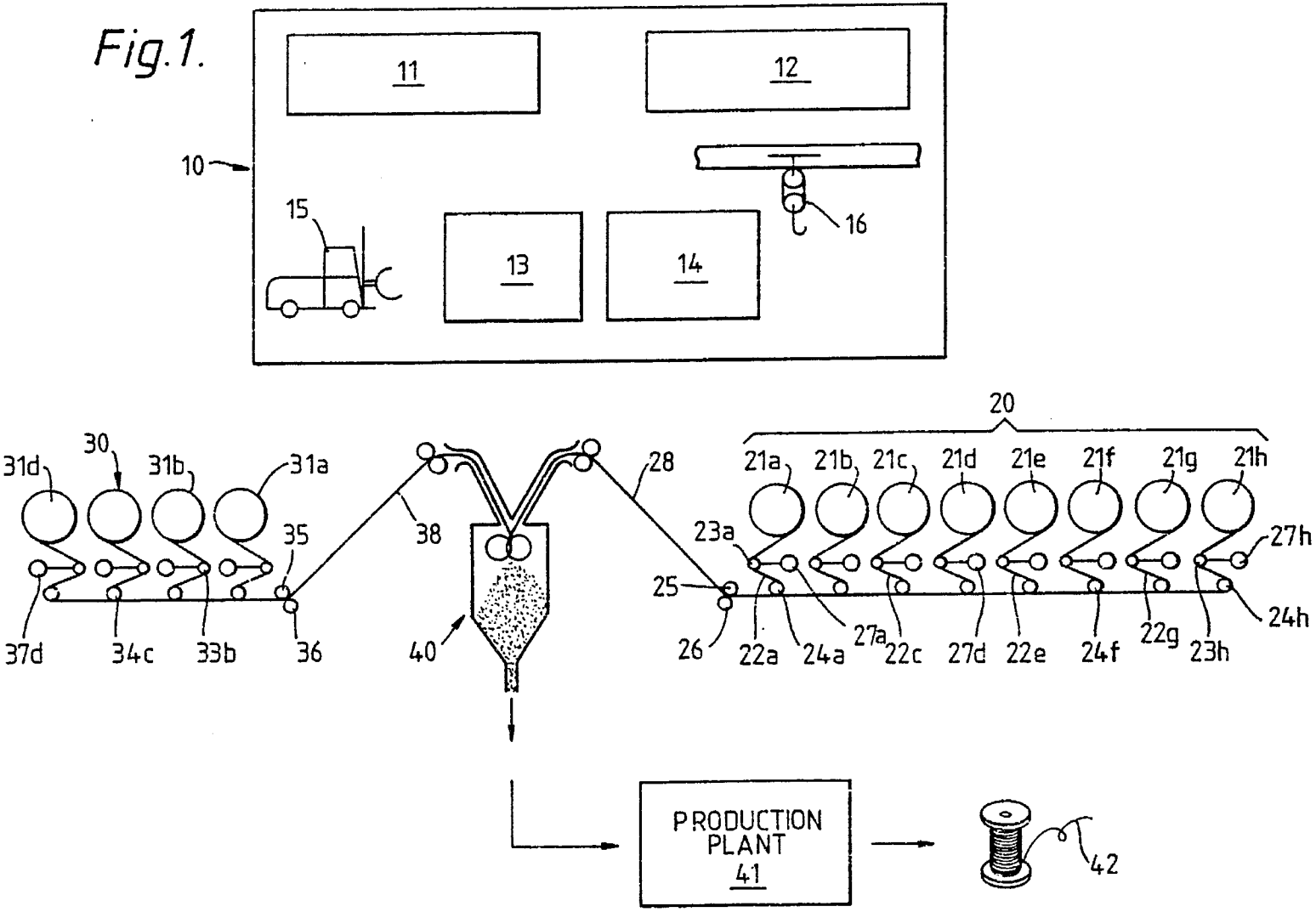
FIG. 1 is a schematic view of two roll stands and an adjacent stock roll storage area.

FIG. 1 shows part of a wood pulp processing plant showing a storage area 10, an LV roll stand 20 and an HV roll stand 30, each roll stand feeding its respective output web to a pulp mill 40.

The LV roll stand 20 comprises eight stock rolls 21*a* . . . 21*h* each feeding sheet material 22*a* . . . 22*h* downwardly to a pair of idler rollers 23*a*, 24*a* . . . 23*h*, 24*h*.

The outlet end of the LV stand 20 is defined by a nip created between a roller pair 25, 26 which frictionally engages the web created from the eight layers of sheet material 22*a* . . . 22*h*. Both rollers 25, 26 are suitably driven to create a desired web advance speed and create the driving traction for withdrawing sheet material from each of the stock rolls 21*a* . . . 21*a*.

To control the path of the sheet from a respective stock roll to the line of advance of the web, idler rollers 23*a* . . . 23*h* and 24*a* . . . 24*h* each bear against the respective sheet in contact with it over part only of its circumference, this degree of contact being sufficient to ensure that, under normal circumstances, there is negligible slippage between the advancing sheet material and at least the respective upper roller 23*a* . . . 23*h*. A motion sensing device (shown schematically at 27*a* . . . 27*h*) is connected to each of the rollers 23*a* . . . 23*h* , these sensing devices being used to determine when sheet material is not being advanced from the respective stock roll e.g. because a breakage has occurred or the stock roll in question has become exhausted of sheet material.

The HV roll stand 30 is similarly constructed to the LV roll stand and for convenience the reference numbers 31–37 have been used to correspond to the numbers 21–27 used in the description of the LV roll stand. It will be noted, however, that there are only four stock rolls on the HV stand so that "d" is the highest reference letter used in connection with the individual stock rolls in the HV stand. The nominal eight-layer web leaving the LV stand 20 has been given the reference number 28 and the nominal four-layer HV web leaving the stand 30 has been given the reference number 38. These pluri-layer webs 28 and 38 are fed together to the comminuting pulp mill schematically illustrated by the reference number 40. The output of the mill 40 is led to a production plant 41 for the manufacture of cellulose fibre 42.

Since the two roll stands are independent with their own nip pair 25:26 and 35:36, the relative speeds of advance of the two webs 28 and 38 can be independently selected to give a desired final feedstock composition in the comminuted material leaving the mill 40.

Figure 2:
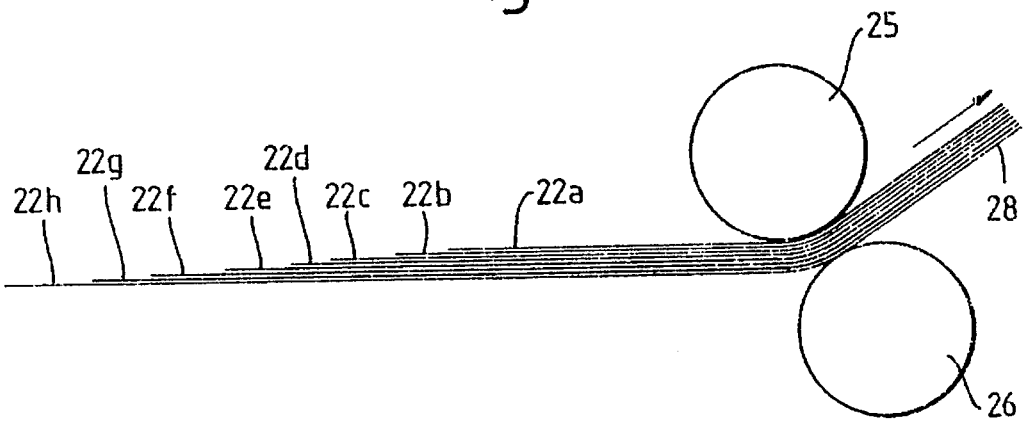
FIG. 2 is an enlarged view of the outlet end of one roll stand showing the pluri-layer web created as feedstock material.
Figure 3:
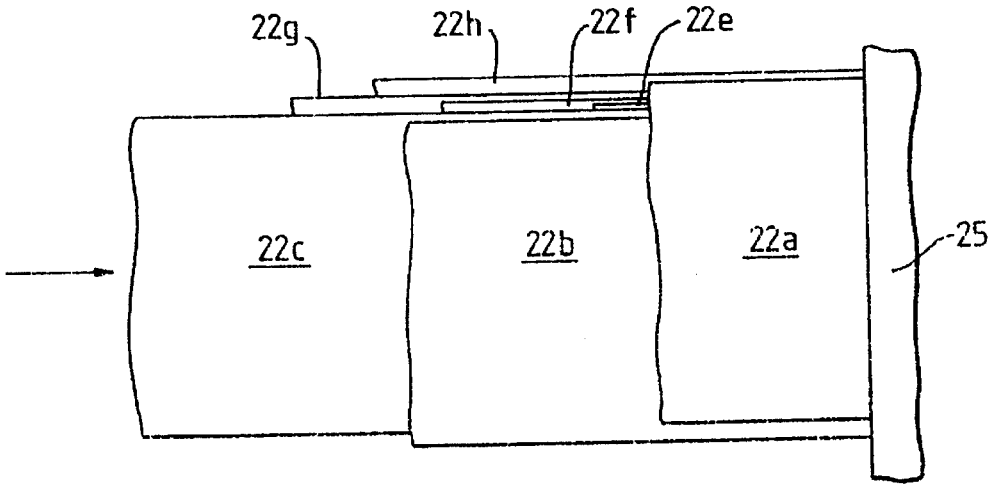
FIG. 3 is a schematic plan of a pluri-layer web leaving a roll stand.

FIG. 2 shows in side elevation and FIG. 3 shows in plan, the composite web 28 leaving the LV stand 20. Eight layers 22*a* to 22*h* are shown in FIG. 2 but only seven layers in FIG. 3, web layer 22*d* being missing due to exhaustion of material from the stock roll 21*d*.

FIG. 1 also shows the storage area 10 which is divided into input areas 11 and 12, respectively, for LV and HV stock rolls received from a supplier and floor stock areas 13 and 14, respectively, for batches of stock rolls selected from the respective LV and HV areas 11 and 12. FIG. 1 also shows a mobile transporter 15 for moving stock rolls around the storage area 10 and a lifting hoist 16 for removing rolls one-by-one from the respective floor stock area 13 or 14 when it is necessary to replace a stock roll in the LV stand 20 or the HV stand 30.

What is claimed is:

1. In the production of a liquid feedstock, used in a cellulosic fibre producing plant, from a plurality of stock rolls of flexible wood pulp sheet material, said rolls differing from one another in a specific property, the improvement which comprises creating a pluri-layer web having at least four different layers of wood pulp sheet material by drawing one layer from each of at least four different stock rolls, selecting the rolls from which said layers are drawn so that said web has an aggregate value of a selected property within a preselected range, breaking up the pluri-layer web to create a mass of comminuted pieces of wood pulp and feeding said comminuted pieces as input feedstock to the plant for forming said liquid feedstock.

2. A method according to claim 1, wherein two or more separate plur-layer webs are created using a separate roll stand for each web and wherein a first pluri-layer web is created from stock rolls of wood pulp having a viscosity rating in a first value band and a second plur-layer web is created from stock rolls of wood pulp having a viscosity rating in a second value band which is higher than said first value band, the input feedstock being created with a preselected ratio of amounts of web material taken from each of said first and second webs.

3. A method according to claim 2, wherein the selecting of stock rolls is chosen having regard to (i) a first aggregate value for the viscosity ratings of the layers making up the first pluri-layer web, (ii) a second aggregate value for the viscosity ratings of the layers making up the second pluri-layer web, and (iii) the proportion of the amount of web material taken from each of said first and second webs.

4. A method according to claim 3, wherein there are more layers of sheet material in the first web than there are layers in the second web.

5. A method according to claim 4, wherein there are 2p/3 layers in the first web and p/3 layers in the second web, p being an integer number which is a multiple of 3 and which is not less than 6.

6. A method according to claim 4, wherein the relative speeds of advance of the two pluri-layer webs can be independently controlled.

7. In a method of making a liquid feedstock from wood pulp for use in a cellulosic fibre production plant, the wood pulp being supplied in rolls of flexible sheet material each having a designated viscosity rating which are fed to a mechanical mill and broken up into pieces to form a comminuted wood pulp feedstock, the improvement which comprises creating the feedstock from a pluri-layer web of "n" layers of sheet material laid one on the other, "n" being an integral number between 4 and 12, drawing the layers of sheet material from a plurality of different stock rolls of selected viscosity rating, selecting the stock rolls from which layers are drawn so that the web has an aggregate value of the viscosity ratings of all the layers in the web lying within chosen range of values of viscosity ratings, and feeding said pluri-layer web to the mill.

8. A method according to claim 7, wherein two or more separate pluri-layer webs are created utilizing separate roll stand for each web and a first pluri-layer web is created from stock rolls of wood pulp sheet material having a viscosity rating in a first value band and a second pluri-layer web is created from stock rolls of wood pulp sheet material having a viscosity rating in a second value band which is higher than said first value band, and wherein there are more layers in the first web than in the second web.

9. A method according to claim 8, wherein each roll stand comprises an unwinding station for each stock roll, each unwinding station including a pair of rollers each contacted only over part of its circumference by the unwinding sheet material from the respective stock roll, and wherein the downstream roller of each pair of rollers in each unwinding station defines an advance path for the pluri-layer web being created in that roll stand.

10. A method according to claim 9, wherein detection of when sheet material from one stock roll is no longer advancing into the pluri-layer web is effected by sensing the motion of one of the rollers in each said pair of rollers using a motion sensing means linked thereto.

11. A method according to claim 9, wherein said advance path of the pluri-layer web is disposed below all the stock rolls in the stand, said advance path terminating in an outlet of the roll stand provided by a pair of nip-defining rollers, at least one of said nip-defining rollers being driven to advance the web and thereby draw sheet material off each of the stock rolls providing input for the web.

12. A method according to claim 11, wherein the roll stand is adjacent to a stock-holding area where stock rolls are stored on receipt from a supplier, the viscosity rating of each stock roll being noted in machine-readable form.

* * * * *

UNITED STATES PATENT AND TRADEMARK OFFICE

CERTIFICATE OF CORRECTION

PATENT NO. : 5,484,508
DATED : January 16, 1996
INVENTOR(S) : Philip J. Urwin, et. al.

It is certified that error appears in the above-indentified patent and that said Letters Patent is hereby corrected as shown below:

| | | |
|---|---|---|
| Col. 3, | line 50, | cancel "21a...21a" and substitute --21a...21h--. |
| Col. 4, | line 41, | before "rolls", insert --stock--. |
| Col. 4, | line 47, | cancel "plur-layer" and substitute --pluri-layer--. |

Signed and Sealed this

Twenty-seventh Day of August, 1996

*Attest:*

Bruce Lehman

BRUCE LEHMAN

*Attesting Officer*

*Commissioner of Patents and Trademarks*